US006282868B1

(12) United States Patent
Vlaam

(10) Patent No.: US 6,282,868 B1
(45) Date of Patent: Sep. 4, 2001

(54) METHOD AND DEVICE FOR STRAPPING OR WRAPPING OBJECTS

(75) Inventor: Henk De Vlaam, Almere (NL)

(73) Assignee: Ferag Verpakkingstechniek B.V., Soest (NL)

( * ) Notice: Subject to any disclaimer, the term of this patent is extended or adjusted under 35 U.S.C. 154(b) by 0 days.

(21) Appl. No.: 09/439,383

(22) Filed: Nov. 15, 1999

(30) Foreign Application Priority Data

Nov. 16, 1998 (CH) ..... 2291/98

(51) Int. Cl.[7] ..... B65B 13/02

(52) U.S. Cl. ..... 53/399; 53/228; 53/370.5; 53/389.2

(58) Field of Search ..... 53/228, 389.2, 53/370.5, 371.3, 372.4, 374.6

(56) References Cited

U.S. PATENT DOCUMENTS

| | | | | |
|---|---|---|---|---|
| Re. 29,362 | * | 8/1977 | Reid | 53/198 R |
| 2,894,363 | * | 7/1959 | Voogd | 53/228 |
| 4,509,314 | * | 4/1985 | Bozza | 53/586 |
| 4,628,668 | * | 12/1986 | Wildmoser | 53/399 |
| 4,991,376 | * | 2/1991 | Backman | 53/399 |
| 6,085,487 | * | 7/2000 | De Vlaaam | 53/176 |

FOREIGN PATENT DOCUMENTS

| | | | | |
|---|---|---|---|---|
| 43 31 351 C1 | | 3/1995 | (DE) . | |
| 160 347 A2 | | 5/1985 | (EP) . | |
| 0 160 347 | * | 11/1985 | (EP) | B65B/11/10 |
| 612 661 A1 | | 11/1993 | (EP) . | |

* cited by examiner

*Primary Examiner*—Peter Vo
*Assistant Examiner*—Hemant M. Desai
(74) *Attorney, Agent, or Firm*—Rankin, Hill, Porter & Clark LLP

(57) ABSTRACT

Objects are conveyed to a strapping position (U) along a conveying path (F), are strapped in this strapping position and are conveyed away from it. For the strapping a strapping material (4) is positioned curtain-like across the conveying path (F) and is drawn along by an object to be strapped such that it is placed around the downstream side of the object and can be positioned on the upstream side of the object and be connected and separated producing a connection point in the strapping closed around the object and in the strapping material (4) again extended across the conveying path for the next object to be strapped. For producing strappings with either one connection point or with two connection points and for allowing the strapping material to be supplied from only one side of the conveying path, shifting steps are carried out alternatingly with strapping steps or with groups of strapping steps in which shifting steps the strapping material (4) is shifted actively across the conveying path (F).

12 Claims, 3 Drawing Sheets a
7
4
20
20'
G
F
8
b
V
b'
c
Z
d
Z'
Z''
e
21
21'
G'
f
30
26
20 21 22 23 24 25 a
7
V'
4
F
8
30'
b
Z
c
Z'
Z''
d
20
20'
G
e
Z
20
f
21,21'
Z'
Z''
20
g
21'
G'
20

METHOD AND DEVICE FOR STRAPPING OR WRAPPING OBJECTS

BACKGROUND OF THE INVENTION

The invention is in the field of the packaging technology and concerns a method and a device for strapping or wrapping objects, particularly substantially parallelepipedic objects.

Substantially parallelepipedic objects such as, for example, stacks of newspapers or magazines, are strapped with tape and/or are wrapped with foil or paper to hold them together and/or to protect them against damage and dirt.

One of the known methods for producing such strapping comprises conveying the object to be strapped to a strapping position. At the strapping position, the strapping material (tape, foil, paper) is positioned to extend curtain-like perpendicular to the conveying direction and across the conveying path. The strapping material is drawn along with the object to be strapped. Thus, the strapping material is placed against the downstream side of the object and can be closed and separated at the upstream side of the object. Accordingly, the object is strapped substantially parallel to the conveying direction and the strapping material again extends across the conveying path ready for the next strapping operation.

The strapped object is conveyed out of the strapping position in the conveying direction, which is substantially the same as the conveying direction to the strapping position. The completed strapping of the object comprises two points in which two ends of the strapping material are connected together, typically by welding, one point on the upstream side of the object and one point on the downstream side of the object.

For strapping methods as described above, the strapping material (tape for strapping or foil or paper for wrapping) is usually supplied from two supply rolls. One supply roll is positioned on each side of the conveying path on which the objects to be strapped are conveyed to the strapping position and away from the strapping position. For each strapping operation the same amount of strapping material is drawn off each supply roll. Controlled deceleration means are usually provided between the conveying path and the supply rolls for controlled drawing of strapping material from the supply rolls and, in particular, for tensioning the strapping material around the objects to be strapped. Furthermore, intermediate storage means is provided in most cases between the deceleration means and the supply rolls. The intermediate storage means stores strapping material drawn from the rolls such that the supply rolls, which usually have a considerable weight, need not be accelerated and decelerated for each strapping operation. Therefore, the intermediate storage means permits a greater drawing-out speed of the strapping material.

When using the known methods and devices for strapping or wrapping as described above it is inevitable that each completed strapping comprises two connection points. It is also inevitable that strapping material needs to be supplied from two sides of the conveying path. This means that, on two sides of the conveying path, supply means and space for the supply means must be provided. This also means that the free ends of the strapping material, supplied from the two sides, must be connected in a special connecting step before a first strapping operation (e.g. after a change of the supply rolls).

SUMMARY OF THE INVENTION

It is the object of the invention to provide a method for strapping or wrapping objects that removes or minimizes the deficiencies in the art. The inventive method makes it possible to produce strappings or wrappings with only one connection point. The present invention also makes it possible to supply the strapping material from only one side of the conveying path.

The inventive method is to be generally applicable independent of characteristics of the strapping material (width, stiffness etc.).

The inventive method improves upon known strapping or wrapping methods according to which each strapping operation comprises conveying the object to be strapped to the strapping position, at which point the object meets the strapping material extending across the conveying path and draws the strapping material along with it. The strapping material is connected and separated on the upstream side of the object such that, on the one hand, the strapping material surrounds the object and, on the other hand, again forms a curtain for a subsequent strapping operation.

In further accordance with the inventive method, a shifting step is carried out between each two successive strapping steps or between each two groups of successive strapping steps. In each of these shifting steps a predetermined length of the strapping material is actively shifted from a side from which this material is supplied (supply side) across the conveying path and to an opposite side of the conveying path. By suitable control of the shifting steps and of the handling of the strapping material on the side of the conveying path opposite to the supply side strappings with only one or with two connection points are selectively produced.

In further accordance with the present invention, a device for carrying out the inventive method comprises conveying means for conveying objects to be strapped to the strapping position (e.g. conveying belts), supply means for supplying strapping material from the supply side to the strapping position (e.g. supply roll and intermediate storage means) as well as means for positioning the strapping material on the upstream side of the object to be strapped and for connecting and separating the strapping material (e.g. suitably equipped and movable welding heads). Furthermore, controlled means for handling the strapping material are provided on the supply side and on the opposite side of the conveying path, whereby control of the handling means is not the same on the two sides. The handling means, apart from a general guiding function, have the following functions in different phases of the inventive method: deceleration of the strapping material (on both sides of the conveying path), active shifting of the strapping material (at least on one side) and holding the strapping material (at least on the side opposite to the supply side).

Advantageously, the handling means provided on both sides of the conveying path are designed as two functional unities (e.g. pairs of rolls) that are brought into different configurations for different functions by suitable control means. However, it is also possible to provide separate handling means for each function and to activate or deactivate the handling means correspondingly.

The device for carrying out the inventive method further comprises control means for controlling the conveying means, the supply means, the connection/separation means as well as the means for handling the strapping material. Control of the device may be purely time or cycle related or it can be governed at least partly by means of sensor signals.

BRIEF DESCRIPTION OF THE DRAWINGS

The inventive method and the inventive device are described in detail in connection with the following figures, wherein.

DETAILED DESCRIPTION OF THE PREFERRED EMBODIMENTS

Figure 1:
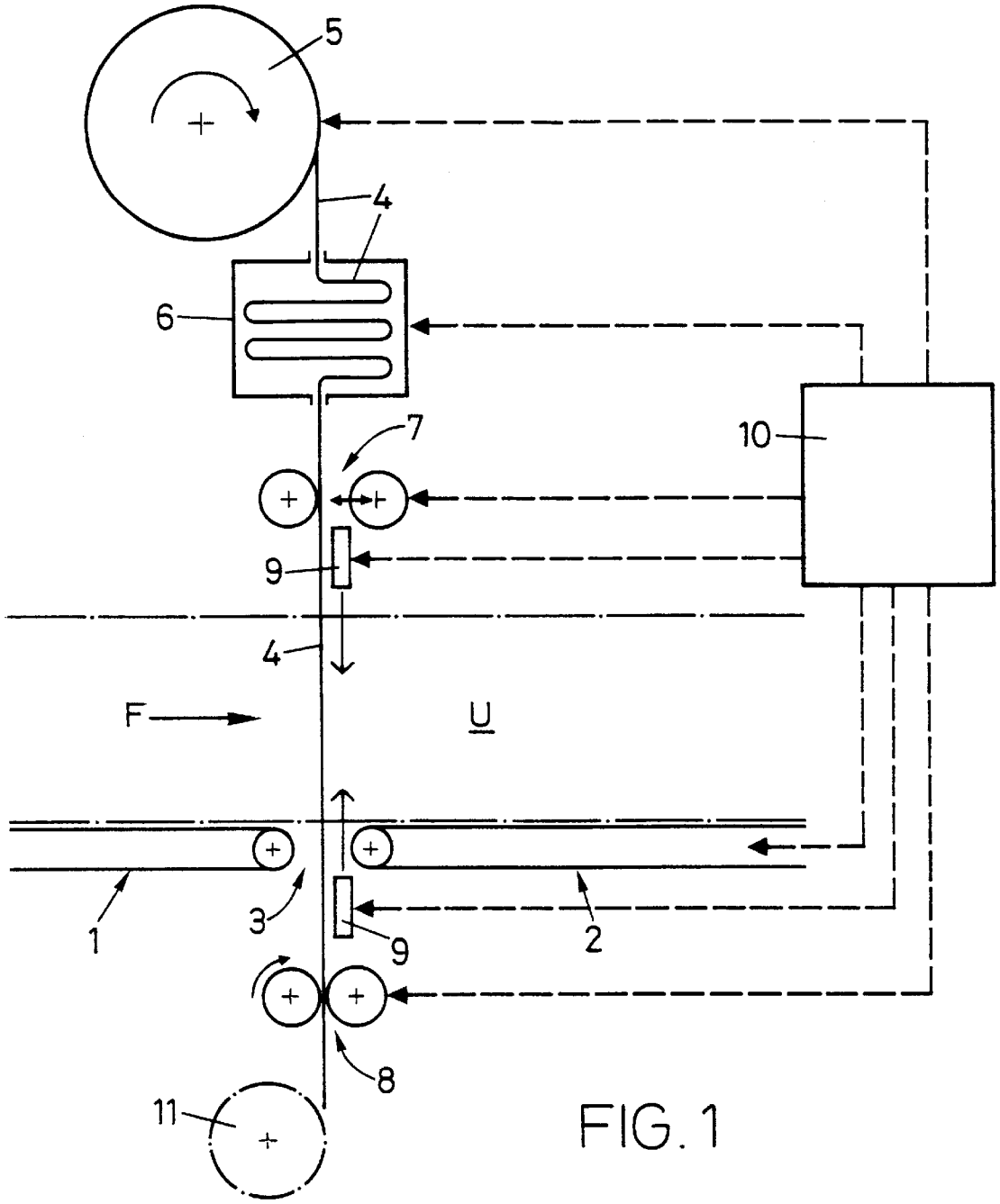
FIG. 1 shows a diagrammatic representation of the main parts of a preferred embodiment of the inventive device.

With reference to FIG. 1, main parts of a preferred embodiment of the inventive device are illustrated. With the help of the device the strapping material is positioned to form a substantially vertical curtain and to extend around the objects to be strapped substantially vertically.

A conveying path F is provided for conveying the objects to the strapping position U and away from the strapping position U and is shown by two parallel broken lines and an arrow. Conveying means for conveying the objects are, for example, two conveying belts 1 and 2 that are spaced from one another at the entrance to strapping position U to form a gap 3. The strapping material 4, which may be a tape, plastic sheeting or paper web of a desired width, is supplied from above in known manner. For example, supply of the strapping material may be with the help of a supply roll 5, which is arranged above the conveying path and rotatably driven in the direction of the arrow, and an intermediate storage 6 for strapping material rolled off the supply roll.

In the region of the entrance side of strapping position U, means for connecting and separating and possibly for tensioning strapping material 4 are provided. The connecting and separating means are, in a per se known manner, movable out of conveying path F for supplying an object to be strapped. The connecting and separating means are also movable against each other on the upstream side of the object for connecting and separating the strapping material 4 drawing the strapping material with them. The means for connecting and separating are, for example, a pair of welding heads such as is described in the publication EP-0592049 and are suitable for connecting and separating thermoplastic strapping tapes.

Above and below conveying path F, means 7, 8 for handling the strapping material are provided. These handling means 7 and 8 are in the illustrated and preferred embodiment pairs of rolls. In a rest configuration, the rolls of each pair are freely rotatable and spaced from each other or at least not pressed against each other. In a decelerating configuration, the rolls are also freely rotatable, but they are pressed against each other with a predetermined pressing force. Accordingly, in the decelerating configuration a predetermined drawing force is needed to draw the strapping material 4 through the pair of rolls. In a holding configuration, the rolls are blocked against rotation and are pressed against each other such that strapping material 4 cannot be pulled through with a force as might occur. In a shifting configuration, the rolls are pressed against each other while one of the rolls is driven to rotate and the other one rotates passively or both rolls are driven to rotate. Accordingly, in the shifting configuration the strapping material 4 positioned between the rolls is actively forwarded.

Depending on the embodiment of the inventive method and on the characteristics of the strapping material it may not be necessary that both handling means 7 and 8 can be brought into all named configurations. Depending on the stiffness of the strapping material, it is advantageous to either push or pull the strapping material across the conveying path, or to move the strapping material actively on both sides of the conveying path in the shifting step.

The inventive device further comprises control means 10 for controlling the supply means (5/6), the conveying means (1/2), the connecting/separating means (9) and the handling means (7, 8). In FIG. 1 corresponding lines for control signals are shown diagrammatically with broken lines and arrows.

In the preferred embodiment of the inventive device shown in FIG. 1 the strapping material is positioned substantially vertically across the conveying path and is supplied from above (supply side above the conveying path). Obviously, the strapping material 4 may also be supplied from below (supply side below the conveying path) or the strapping material 4 may be positioned substantially horizontally across the conveying path being supplied from one or the other lateral side of the conveying path (supply side right or left of the conveying path).

For guiding strapping material shifted to the conveying path side opposite to the supply side, guiding means can, if necessary, be provided. Such guide means may include a roll 11 shown in broken lines in FIG. 1, or a suitable container.

Figure 2:
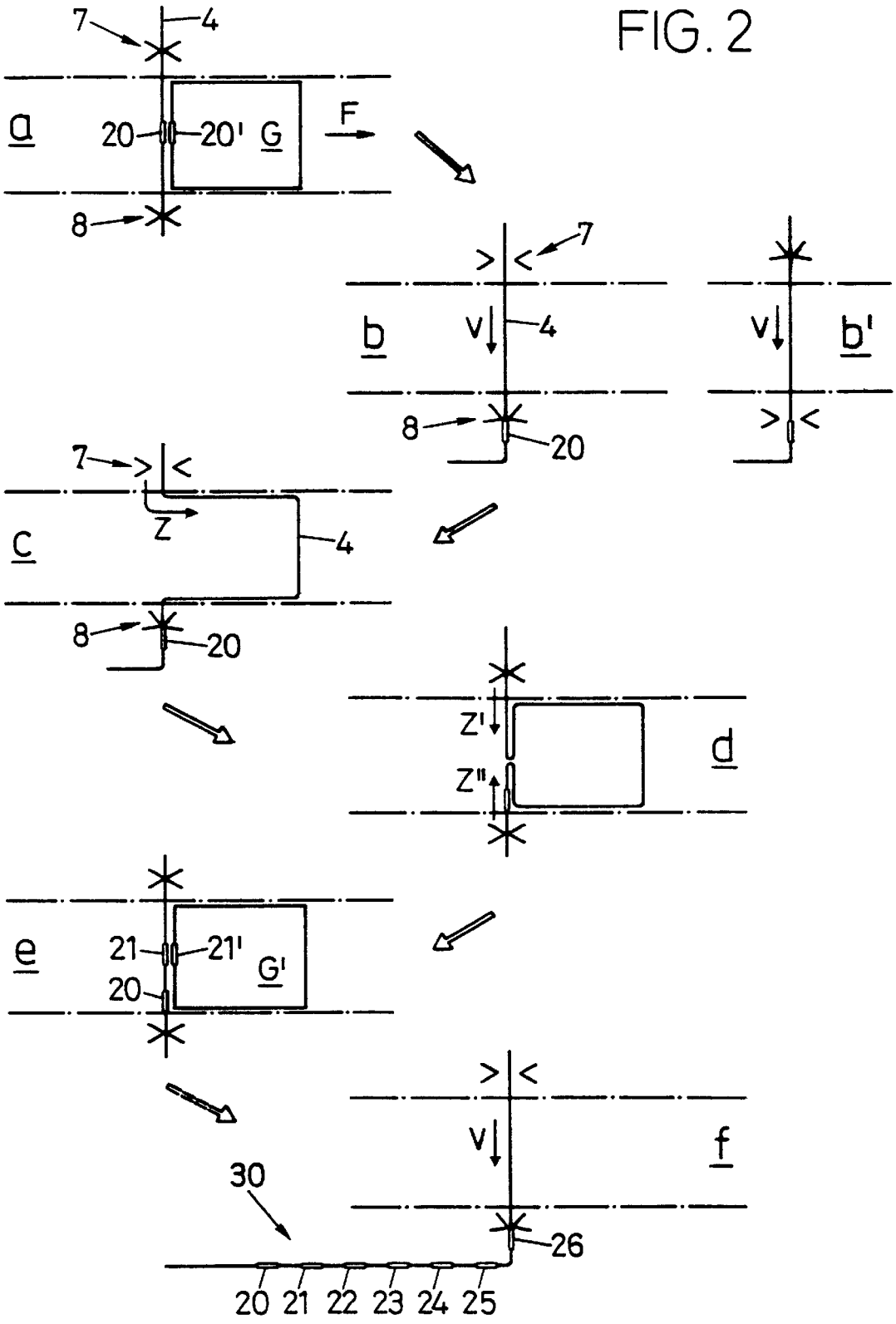
FIGS. 2*a*–2*f* schematically illustrate successive method steps according to a first preferred embodiment of the method according to the present invention; and, FIGS. 3*a*–3*g* schematically illustrate successive method steps according to a second preferred embodiment of the method according to the present invention.
Figure 3:
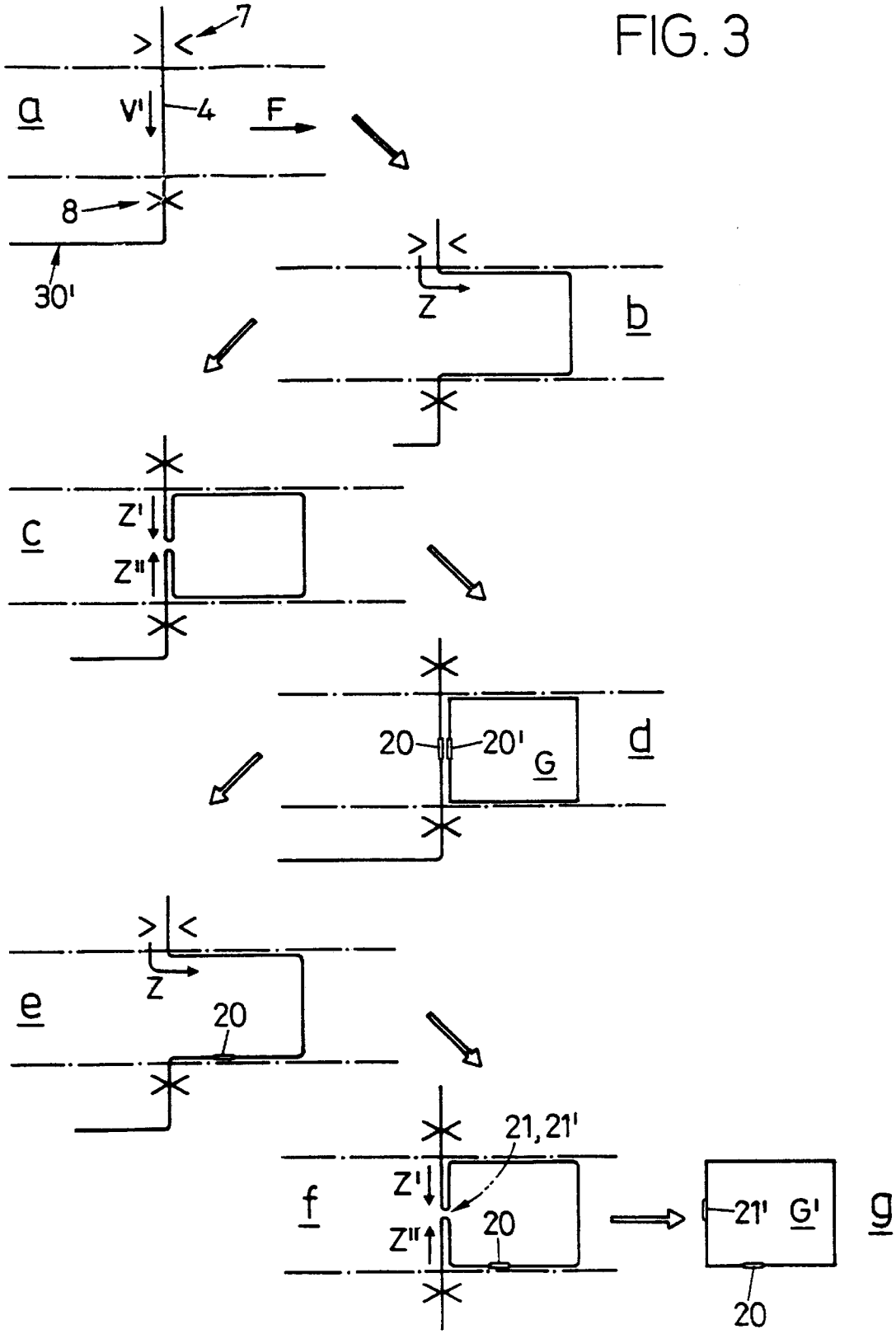

FIGS. 2 and 3 show very diagrammatically successive method steps of two preferred embodiments of the inventive method. Reference numerals in FIGS. 2 and 3 correspond to those used in FIG. 1, when appropriate. Means 7 for handling strapping material 4 on the supply side and handling means 8 on the opposite side are shown as ><, whereby different configurations are shown by different relative positions of the left and right symbol part.

FIGS. 2*a*–2*f* show an embodiment of the inventive method with alternating strapping and shifting steps, whereby in the shifting steps a predetermined length of strapping material 4 is shifted from the supply side of the conveying path F (above the conveying path) to the opposite side (below the conveying path) and strappings with only one connection point are produced.

With reference to FIG. 2*a*, strapping of an object G is completed and the strapping material 4 extends across conveying path F in a substantially vertical direction and comprises a connection point 20 with a position that corresponds to the position of the connection point 20' on the strapping of object G. The two handling means 7 and 8 are in a decelerating configuration in the last phases of the previous strapping step.

With reference to FIG. 2*b*, the drawing illustrates a shifting step between two successive strapping steps in which shifting step strapping material 4 is shifted from the supply side to the opposite side of the conveying path (arrow V). The handling means 7 on the supply side is in a resting configuration while the other handling means 8 is in a shifting configuration (strapping material is pulled across the conveying path). Alternatively, if the strapping material has enough stiffness to be pushed across the conveying path, the handling means 7 on the supply side can be in the shifting configuration while the other handling means 8 is in resting configuration illustrated in FIG. 2*b*'. (strapping material being pulled across the conveying path). It is also thinkable that the strapping material is moved actively and synchronically on both sides (both handling means 7 and 8 in shifting configuration) for being shifted.

For the shifting step, means 7 and/or 8 for handling the strapping material can be driven for shifting during a predetermined shifting time at a predetermined shifting speed.

It is also possible to watch with a suitable sensor the most recently produced connection point or the position of the free end of the strapping material 4 and to use the sensor signals for controlling the handling means 7 and/or 8.

With reference to FIG. 2*c*, this drawing illustrates the drawing of the strapping material 4 by an object following object G (following object not shown) being conveyed to the strapping position, whereby the strapping material is drawn from the supply side (arrow Z) only. The free end of strapping material 4 is held by handling means 8 (holding configuration) and is drawn through the handling means 7 (resting configuration) on the supply side.

FIG. 2*d* illustrates the movement of the connecting/separating means to the upstream side of the following object, whereby the strapping material is drawn from both sides (arrows Z' and Z"). It is also noted that, for tensioning the strapping material, the two handling means 7 and 8 are in the decelerating configuration.

With reference to FIG. 2*e*, this drawing illustrates the finishing of the strapping of the following object G' by producing the two connection points 21 and 21' and by corresponding separation of strapping material 4. In this step, the two handling means 7 and 8 are in decelerating configuration.

The step shown in FIG. 2*f* illustrates a shifting similar to that shown in FIG. 2*b*. It is noted that step b (FIG. 2*b*) is the first shifting step after a first strapping step, e.g. after mounting a new supply roll, whereas step f (FIG. 2*f*) is the shifting step after seven strapping steps and the corresponding number of shifting steps. It is clearly visible that the free end of the strapping material has been further removed from handling means 8 in each shifting step and that the growing end region 30 of the strapping material comprises all connection points 20 to 26. The end region 30 is advantageously removed from the device when the supply roll is exchanged. End region 30 represents, depending on the size of the objects to be strapped and on the length of the connection points a larger or smaller part of the strapping material of each supply roll which is used, This part will in most cases be a few percent of the totally used material and for most strapping materials it can be recycled.

For the method according to FIG. 2, the control of the handling means 7 and 8 is substantially as follows:

Shifting step (b, b', f): 7 or 8 in shifting configuration and 8 or 7 in resting configuration or 7 and 8'in shifting configuration;

Conveying an object to be strapped to the strapping position (c): 7 in resting configuration, 8 in holding configuration;

Positioning the strapping material on the upstream side of the object to be strapped and connecting separating (a, d/e): 7 and 8 in decelerating configuration.

Normally, the shifting step is laid out such that the shifted length V of strapping material is as small as possible. However, the shifted length V is larger by at least the length of connection point 20 than the length Z" drawn out for positioning of the strapping material on the upstream side of the object to be strapped. In this manner, a connection point 20 produced in a strapping step does not conflict with a connection point 21 produced in the following strapping step. For very thin strapping materials it may be possible for the connection points to slightly overlap on end region 30. In this case V–Z" must be larger than half the extension of a connection point.

For strapping material that does not slip easily on the object to be strapped (e.g. adhesion film) it is advantageous to not only draw the strapping material from the side opposite to the supply side when positioning the strapping material on the upstream side of the object to be strapped (method step d - FIG. 2*d*) but to already do so when the object to be strapped is conveyed into the strapping position. For this purpose a correspondingly greater length of strapping material must be shifted across the conveying path in the shifting step.

For the method according to FIGS. 2*a*–2*f*, the free strapping material end of a newly introduced supply roll is guided across the conveying path by handling means 7 on the supply side to be introduced into handling means 8 on the opposite side. The first strapping step can follow directly.

FIGS. 3*a*–3*g* show, in the same manner as FIGS. 2*a*–2*f*, a second, preferred embodiment of the inventive method in successive method steps. This method comprises a shifting step which precedes a group of strapping steps (e.g. all strapping steps which are carried out with one supply roll) and produces strappings with two connection points (except for the first strapping of the group).

FIG. 3*a* illustrates a shifting step wherein strapping material is shifted from the supply side to the opposite side of conveying path F (arrow V'). An end region 30' forms and may be rolled onto a correspondingly positioned roll (10 in FIG. 1) or may be deposited in a suitable container.

FIGS. 3*b*–3*d* show a first strapping step in which, like in the method according to FIG. 2, a first object G is strapped. On conveying the object to the strapping position strapping material is exclusively drawn from the supply side (Z) and, when the strapping material is positioned on the upstream side of the object to be strapped, strapping material is drawn from both sides (Z' and Z"). During this first strapping operation, a connection point 20 is formed in the strapping material extending across the conveying path and a connection point 20' is formed on the strapping of object G (FIG. 3*d*). End region 30' is shortened by length of the drawn strapping material Z".

When strapping a following or subsequent object G', which is shown in FIGS. 3*e*–3*f* (which are analogous to FIGS. 3*b*–3*d*) new connection points 21 and 21' are formed, whereby the connection point 20 is positioned on the strapping of the following object G' and end region 30' is shortened again.

For carrying out the method according to FIG. 3, handling means 7 and 8 are controlled in the following manner:

Shifting step (a): 7 or 8 in shifting configuration and 8 or 7 in resting configuration or 7 and 8 in shifting configuration;

Supplying of the object to be strapped (b or e): 7 in resting configuration, 8 in holding configuration;

Positioning of the strapping material on the upstream side of the object to be strapped and connecting/separating (c/d or f/e): 7 and 8 in decelerating configuration.

The shifting step that is carried out before a group of n strapping steps is aid out such that the shifted length V' of strapping material has a length of at least n times the drawn length Z". Z" is at least as large as the extent of a connection point in the direction of the strapping material length (no overlap of the connection points) or possibly at least as large as half of this extent (overlap of the connection points). The length of strapping material Z" which is drawn from the side of the conveying path opposite to the supply side when the strapping material is positioned on the upstream side of the object to be strapped is determined by the control of the connecting/separating means or by the position of the connection point on the upstream side of the strapped object, respectively. Obviously, in the method according to FIGS.

3*a*–3*g*, strapping material 4 may also be drawn from the side opposite the supply side by the object to be strapped being conveyed to the strapping position. In this case the length of strapping material shifted in the shifting step is to be increased correspondingly.

The shifting step according to the method according to FIGS. 3*a*–3*g* is carried out by suitable control of the supply means and handling means, e.g. after the free end of a new supply roll has been guided to the side of the conveying path opposite the supply side. It is also possible to carry out the shifting step manually by positioning a further, possibly smaller supply roll on the side opposite the supply side and by connecting with special means both ends of the strapping material before the first strapping step.

In a method according to FIGS. 3*a*–3*g*, unlike in a method according to FIGS. 2*a*–2*f*, no waste is produced.

The method according to FIGS. 2*a*–2*f* can be combined with the method according to FIGS. 3*a*–3*g*. This means that a shifting step is not only carried out when the supply roll is exchanged but always after a plurality of strapping steps, whereby after each shifting step a first object receives a strapping with only one connection point and whereby an end region is formed on which connection points from all these first strapping steps are collected.

Possibly it is necessary to press the object to be strapped before and/or during the strapping using suitable pressing means, in particular if the object is a stack of compressible flat items.

What is claimed is:

1. A method for wrapping a material around an object or a group of objects, the method comprising the steps of:

conveying the objects in succession along a conveying path to a strapping position and away from the strapping position, at the entry of the strapping position supplying a strapping material from a supply side of the conveying path and extending across the conveying path to an opposite side of the conveying path, drawing the strapping material along with each object being conveyed to the strapping position and thereby placing the strapping material around a downstream side of the object and connecting and separating the strapping material on an upstream side of the object, said strapping material extending around the object and being closed with a connection point and wherein, for strapping a following object, the strapping material extends again across the conveying path having a further connection point, wherein, before strapping one object or a group of objects, a predetermined length of the strapping material is shifted from said supply side of the conveying path to said opposite side of the conveying path;

wherein, for positioning the strapping material (4) on the upstream side of the object (G) to be strapped, strapping material is drawn from the opposite side of the conveying path and wherein the shifting steps are controlled in dependence of the length (Z") of the drawn strapping material and in dependence of the extent of the connection points in the direction of the strapping material length; and, wherein, before each group of n strapping steps, wherein n is an integer, one shifting step is carried out wherein a length (V') of strapping material (4) being shifted across the conveying path is at least as long as n times the drawn length (Z"), whereby in each first strapping step of said group of n strapping steps a strapping with one connection point (20') is produced and in further strapping steps of the group of n strapping steps a strapping with two connection points (21'/20) is produced.

2. Method according to claim 1, wherein the drawn length (Z") is larger than the extent of a connection point in the direction of the strapping material length.

3. Method according to claim 1, wherein the group of n strapping steps comprises all strapping steps that can be carried out with the strapping material of one supply roll.

4. Method according to claim 1, wherein the strapping material (4) is selected from the group consisting of tape, foil, and paper strip.

5. Method according to claim 1, wherein the strapping material (4) consists at least partly of a thermoplastic material and the connection points are produced by welding the thermoplastic material together.

6. A device from strapping or wrapping objects, the device comprising:

conveying means (1/2) for conveying objects along a conveying path (F) to a strapping position (U) and away from the strapping position (U), supply means (5/6) for supplying a strapping material (4) to the strapping position (U) from a supply side of the conveying path, handling means (7, 8) for handling the strapping material on said supply side and on a side of the conveying path opposite the supply side and for extending the strapping material across the conveying path from the supply side to the opposite side, connecting/separating means (9) for positioning the strapping material on an upstream side of an object (G) to he strapped and for connecting and separating the strapping material (4), and control means for controlling the conveying means (1/2), the supply means (5/6), the connecting/separating means (9) and the handling means (7, 8), wherein said control means is operable to bring said handling means (7,8) into a shifting configuration for actively drawing a length of strapping material from the supply means and shifting the strapping material (4) across the conveying path, and wherein, before each group of n strapping steps, wherein n is an integer, said control means initiates one shifting step wherein a length (V') of strapping material (4) being shifted across the conveying path is at least as long as n times a drawn length (Z"), as a result of which in each first strapping step of a group of n strapping steps a strapping with one connection point (20') is produced and in further strapping steps of the group of n strapping steps a strapping with two connection points (21'/20) is produced.

7. The device according to claim 6, wherein the handling means (8) on the side of the conveying path (F) opposite the supply side can be brought into a holding configuration.

8. The device according to claim 6, wherein the handling means (7, 8) include pairs of rolls.

9. The device according to claim 6, wherein the supply means (5/6) comprise a supply roll (5) and intermediate storage means (6).

10. The device according to claim 6, wherein the connecting/separating means comprise welding heads for welding of thermoplastic materials.

11. The device according to claim 6, wherein sensors are provided for activating the control unit (10).

12. The device according to claim 6, wherein, for guiding strapping material (4) shifted across the conveying path, a roll (11) is arranged on the side of the conveying path (F) opposite the supply side.

* * * * *

UNITED STATES PATENT AND TRADEMARK OFFICE

CERTIFICATE OF CORRECTION

PATENT NO. : 6,282,868 B1
DATED : September 4, 2001
INVENTOR(S) : Vlaam

It is certified that error appears in the above-identified patent and that said Letters Patent is hereby corrected as shown below:

Column 6,
Line 55, delete "aid" and insert -- laid --

Column 8,
Line 14, delete "from" and insert -- for --.

Signed and Sealed this

Twelfth Day of March, 2002

*Attest:*

*Attesting Officer*

JAMES E. ROGAN
*Director of the United States Patent and Trademark Office*